US007290411B1

(12) United States Patent
Lonati

(10) Patent No.: US 7,290,411 B1
(45) Date of Patent: Nov. 6, 2007

(54) OSCILLATING CONTROL DEVICE FOR LINEAR KNITTING MACHINES THREAD-GUIDE BARS

(75) Inventor: Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 11/726,166

(22) Filed: Mar. 21, 2007

(30) Foreign Application Priority Data

Mar. 23, 2006 (IT) ..... BS2006A0066

(51) Int. Cl.
*D04B 27/24* (2006.01)

(52) U.S. Cl. ..... 66/207; 66/204

(58) Field of Classification Search ..... 66/207, 66/204, 205, 208
See application file for complete search history.

(56) References Cited

U.S. PATENT DOCUMENTS 3,221,520 A 12/1965 Bassist
3,403,536 A * 10/1968 Inabi ..... 66/207
3,444,703 A 5/1969 Kohl
3,802,226 A * 4/1974 Kohl ..... 66/204
4,835,989 A * 6/1989 Hall et al. ..... 66/203
6,289,703 B1 9/2001 Kress et al.

FOREIGN PATENT DOCUMENTS

DE 19781593 B4 11/2006
WO WO 98/26120 A 6/1998
WO WO 03/071018 A1 8/2003

* cited by examiner

*Primary Examiner*—Danny Worrell
(74) *Attorney, Agent, or Firm*—Pearne & Gordon LLP

(57) ABSTRACT

An oscillating control device (1) for thread-guide bars (2) of linear knitting machines (60), comprising a support (5) that can rotate around a middle axis (6) to which at least one thread-guide bar (2) can be associated, movement means (10) for the support (5), and transmission means (20) operatively connected to the movement means (10) for imparting an oscillating movement to the support (5). The transmission means (20) are operatively associated to the support (5) on at least two separate actuating points (7*a*, 7*b*) for moving it with an oscillating movement in a balanced manner with respect to the middle axis (6) thereof. In particular, a pushing action and a pulling action are applied simultaneously on the two actuating points (7*a*, 7*b*) by the movement means (10) through the transmission means (20).

31 Claims, 7 Drawing Sheets

OSCILLATING CONTROL DEVICE FOR LINEAR KNITTING MACHINES THREAD-GUIDE BARS

FIELD OF THE INVENTION

The present invention relates to an oscillating control device for thread-guide bars of linear knitting machines, also known as Raschel-type warp looms, tricot, crochet or the like.

BACKGROUND OF THE INVENTION

As is known, Raschel-type linear knitting machines are provided with a plurality of bars designed to carry a plurality of thread-holding elements, commonly known as thread-guides. Said bars should be moved so as to enable the threads associated to the thread-guides to be correctly fed onto the needles of the knitting machine for the formation of new fabric with the well-known technique in which the new thread enters the old loop and the old loop is discharged and becomes part of the fabric being formed. In order to achieve its knitting task, the thread-guide bar makes two basic movements simultaneously, i.e. a first linear movement in front of the hook of each needle, commonly known as "shog", and an oscillating movement on the side of each needle for bringing the threads alternatively before and behind the needle hook, commonly known as "swing".

The present invention relates to a device for enabling the oscillating movement ("swing") for the thread-guides.

Currently, in linear knitting machines the oscillation of the thread-guide bars, which is usually of 4° to 10°, is obtained by means of several methods, all of which exploit leverage systems, such as quadrilaterals, suitably connected to one another and derived from systems for handling the rising and descent of needles for the formation of the knitted stitch, as is shown for instance in documents WO 03/071018 and U.S. Pat. No. 3,221,520. Accordingly, the whole mechanism of the machine is rigorously synchronized in its basic movements, whatever the speed at which the machine is running.

As is known, thread-guide bars, eight of them being generally present on double needle-bed machines, are associated to at least one support, which is in its turn connected to said leverage systems for transmitting the oscillating movement thereof. Said bars are connected to two supports, each of them being placed on one of the end portions thereof. If necessary, it can further be provided for intermediate resting supports, which can both actively transmit the oscillating movement and be passively subjected to it.

As was already said, the leverages convert the linear movement resulting from the needles into an oscillating movement for the thread-guide bars. As a matter of fact, the oscillating movement is generated by the movement of a rod connected to the support of the thread-guide bars so as to make it rotate around the axis of the shaft supporting it. As a rule, as can be seen in FIG. 1, the support of the thread-guide bar is made up of a main body to which the bars as connected, and of a supporting arm, upon which the rod acts and which has a main axis basically perpendicular to the main axis of the main body. Moreover, the support is associated to the shaft supporting it on the point of connection between the arm and the main body, which is also the center of rotation for said support. This particular structure allows to obtain an oscillating movement for the main body starting from the linear movement of the arm obtained by means of the rod.

Known devices as disclosed above show various drawbacks. Firstly, the systems for transmitting motion from the motor of the machine to the thread-guide bars are quite complex, since they have to be extremely accurate because of the narrow spaces in which needles and thread-guides work with respect to the overall size of the machines, and require a very large number of components. This increases costs hugely. Moreover, the mechanical complexity of the devices strongly limits their speeds of use, and thus said machines often represent a bottleneck in the manufacturing system into which they are integrated.

Secondly, said devices have a very low flexibility, since it is very difficult to make after-changes to them because of their complexity. Even maintenance operation for repairing or replacing elements can be complex. Anyhow, these operations require the intervention of specialized personnel working for the company that has made the machines, with subsequent problems of production stops and further cost increase.

Eventually, another problem with known systems consists in the need to continuously invert the direction of movement of the support, and thus of the thread-guide bars, so as to make oscillations. As a matter of fact, the masses involved, which are quite high, have to be pushed in one direction, so as to create a counterclockwise oscillation for instance, then at stroke end they have to be braked and pushed in the opposite direction, so as to make the following clockwise oscillation for instance. Such a device, therefore, gives rise to several mechanical problems leading inevitably to solutions involving large overall sizes of stressed components and strong reductions of operating speeds. Moreover, said devices generate very strong vibrations that have to be absorbed by the machine through suitable measures, such as for instance big anti-vibration supporting structures.

The state of the art shows devices mitigating the problem disclosed above, though further increasing costs. They are basically made up of eccentric systems based on the principle of connecting rod-crank imparting a sinusoidal movement to the support, as shown in FIG. 2. The sinusoidal movement of the connecting rod slows down the stroke of the support on the point of inversion of the movement, thus greatly reducing vibrations and discharging the forces of inertia generated on the various mechanical connections as far as the motor.

Moreover, known knitting machines can include even more than two of the conventional devices associated to the ends of the thread-guide bars. For instance, in a machine with a needle-bed having a length of about 3.5 m, there can be 8 devices spaced from one another of about 0.5 m. As a matter of fact, the use of several devices enables to reduce size and, therefore, to obtain higher speeds of use. However, in this case the size of the motor and of the shaft connected thereto significantly increases, since eight of these devices are fitted onto the shaft, together with other devices involved in the movement of needles and other elements, which devices increase the forces of inertia involved due to the masses in movement that have to be moved in a suitable manner both at constant speed and during acceleration or braking.

It should be pointed out that, generally, these devices are located in the portion containing the rear needle-bed, thus leaving the front portion of the machine free for different reasons, also of economical nature. Therefore, the system is not balanced and gives rise to vibrations occurring also at low speeds (350 oscillations per minute for instance).

BRIEF SUMMARY OF THE INVENTION

The aim of the present invention is to solve the problems at the state of the art by proposing an oscillating control device for thread-guide bars of linear knitting machines without the drawbacks described above. Therefore, an aim of the present invention is to propose an oscillating control device for thread-guide bars of linear knitting machines that enables to reduce the manufacturing and management costs of the knitting machines. As a consequence, an aim of the invention is to provide an oscillating control device for thread-guide bars of linear knitting machines that has a small number of components and enables to simplify the structure of the machine and the construction and management thereof, especially as far as maintenance is concerned.

A further aim of the invention is to show an oscillating control device for thread-guide bars of linear knitting machines that is very accurate and ensures a high quality of the finished item.

Still another aim of the present invention is to increase the operating speed of the knitting machine so that the knitting station represents no more a bottleneck in the whole manufacturing process of knitted items.

Moreover, an aim of the invention is to show an oscillating control device for thread-guide bars of linear knitting machines that generates on the supports, and therefore on the thread-guide bars, a controlled and balanced oscillating movement especially in the critical steps of acceleration, braking and movement inversion, so that a strong oversizing of the structural components of the machine is not required and the generation of vibrations and shakes is reduced.

A final aim of the invention is to show an oscillating control device for thread-guide bars of linear knitting machines that enables to balance the forces acting upon the machine, so that the knitting machine has a compact, rational and dynamically balanced structure.

These and other aims that will emerge from the following description are achieved, according to the present invention, by an oscillating control device for thread-guide bars of linear knitting machines in accordance with the appended claims.

BRIEF DESCRIPTION OF THE DRAWINGS

The invention will now be disclosed in further detail thanks to the drawings, which represent a merely exemplary and non-limiting embodiment thereof.

DETAILED DESCRIPTION OF THE PREFERRED EMBODIMENTS OF THE INVENTION

Figure 2:
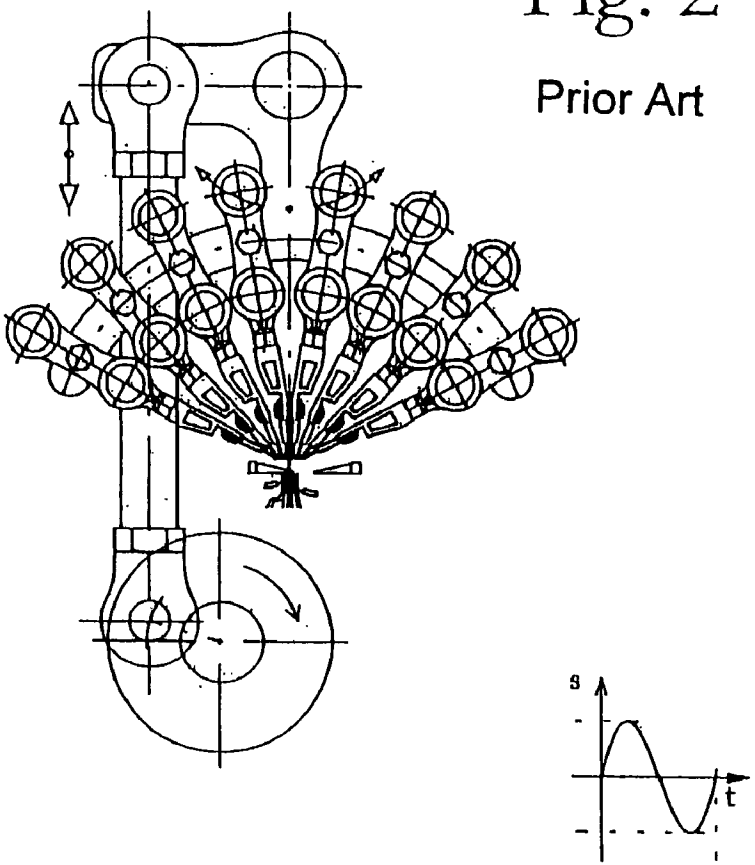
Fig. 2 Prior Art
FIGS. 1 and 2 show examples of known oscillating control devices for thread-guide bars of linear knitting machines.
Figure 1:
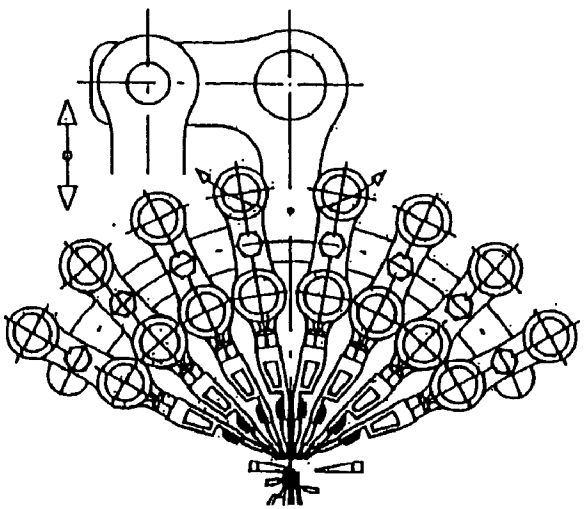
Fig. 1 Prior Art

With reference to the figures mentioned above, an oscillating control device 1 for thread-guide bars 2 of linear knitting machines 60 according to the present invention comprises a support 5 that can rotate around a middle axis 6 to which at least one thread-guide bar 2 can be associated, movement means 10 for the support 5, and transmission means 20 operatively connected to the movement means 10 for imparting an oscillating movement to the support 5.

The device 1 is characterized in that the transmission means 20 are operatively associated to the support 5 on at least two separate actuating points 7*a*, 7*b* for moving it with an oscillating movement in a balanced manner with respect to the middle axis 6 thereof.

Figure 3:
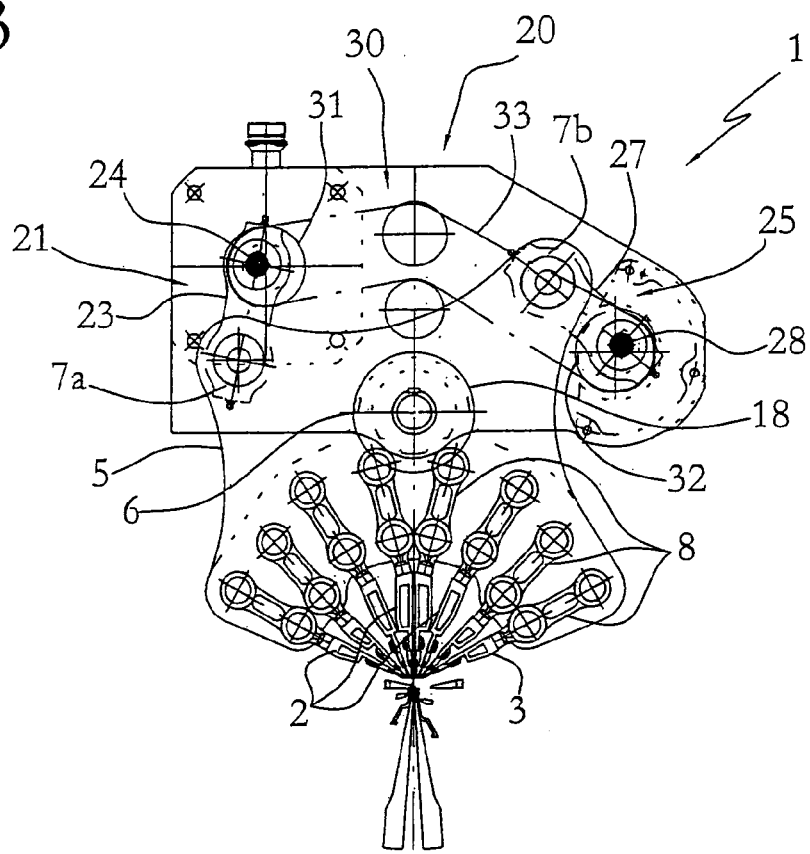
FIG. 3 shows a side view of an oscillating control device for thread-guide bars of linear knitting machines in accordance with the invention.

As can be seen in FIG. 3, said points 7*a*, 7*b* for actuating the support 5 are opposed with respect to a vertical plane containing the middle axis 6. Moreover, a pushing action and a pulling action are applied simultaneously on the two actuating points 7*a*, 7*b*, respectively, by the movement means 10 through the transmission means 20. In further detail, every time the support 5 moves with an oscillating movement, a pushing action is applied on one of two actuating points 7*a*, 7*b* and a pulling action is applied on the other one. As a consequence, these devices 1 can also be defined "push-pull" devices.

It is thus possible to balance the forces acting upon the device 1 and to control their dynamics effectively. Moreover, the oscillating movement of the support 5 takes place in a plane basically perpendicular to the longitudinal development of the thread-guide bars 2, so that the middle axis 6 of said support 5 is basically parallel to the main axes of the thread-guide bars 2. The transmission means 20 comprise main transmission means 21 operatively connected to the movement means 10, and secondary transmission means 25 operatively connected to the main transmission means 21 and moved by the latter. The main transmission means 21 act upon the support 5 on a first actuating point 7*a*, whereas the secondary transmission means 25 act upon it on a second actuating point 7*b* (FIGS. 3 and 6).

Advantageously, therefore, the main and secondary transmission means 21, 25 exert onto the support 5, by means of the corresponding actuating points 7*a*, 7*b*, the pushing action and the pulling action, respectively, for oscillations in one direction and vice versa for oscillations in the other direction.

Figure 6:
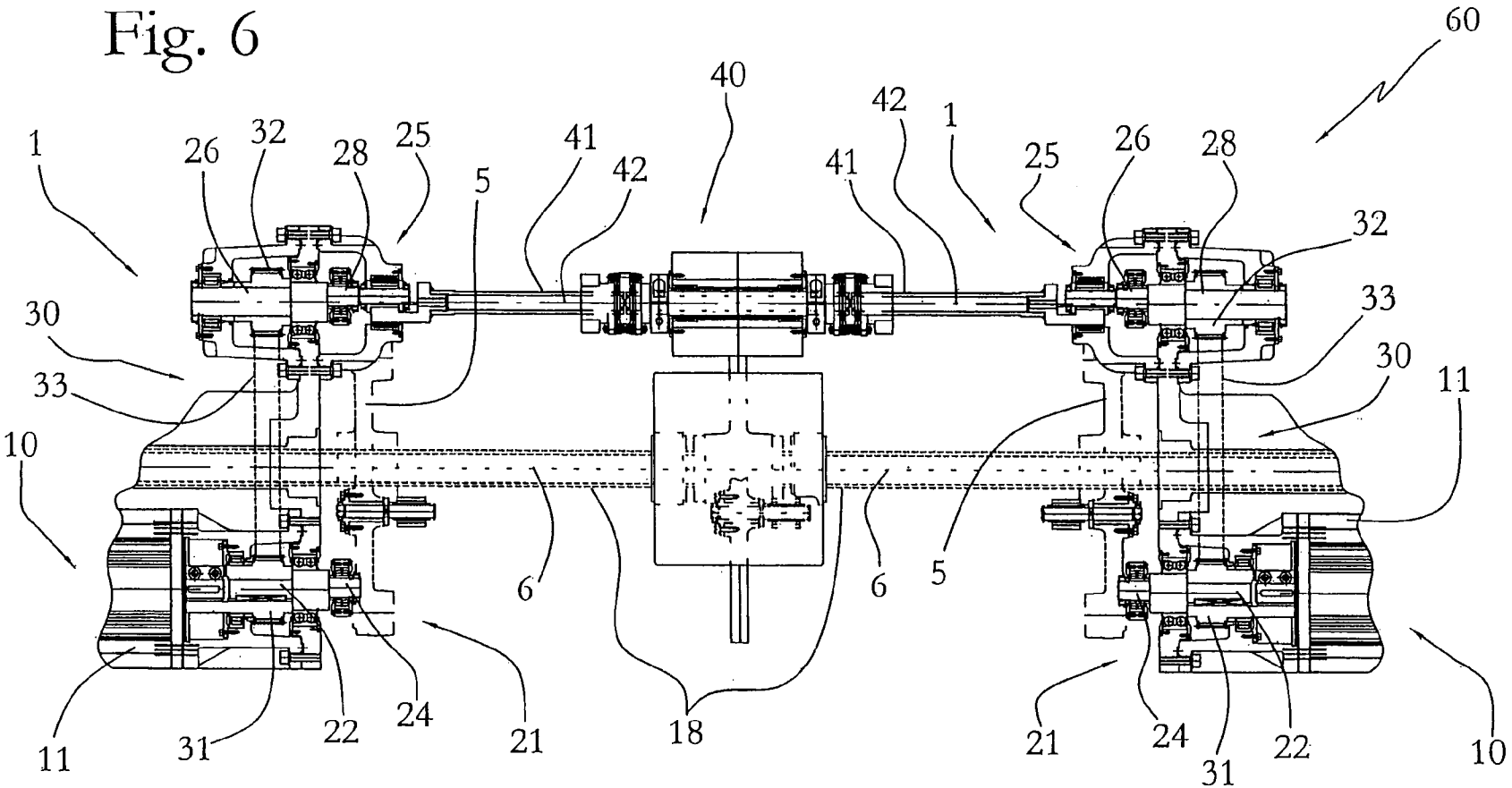
FIG. 6 shows a top view of the machine according to the invention in the first embodiment thereof.
Figure 7:
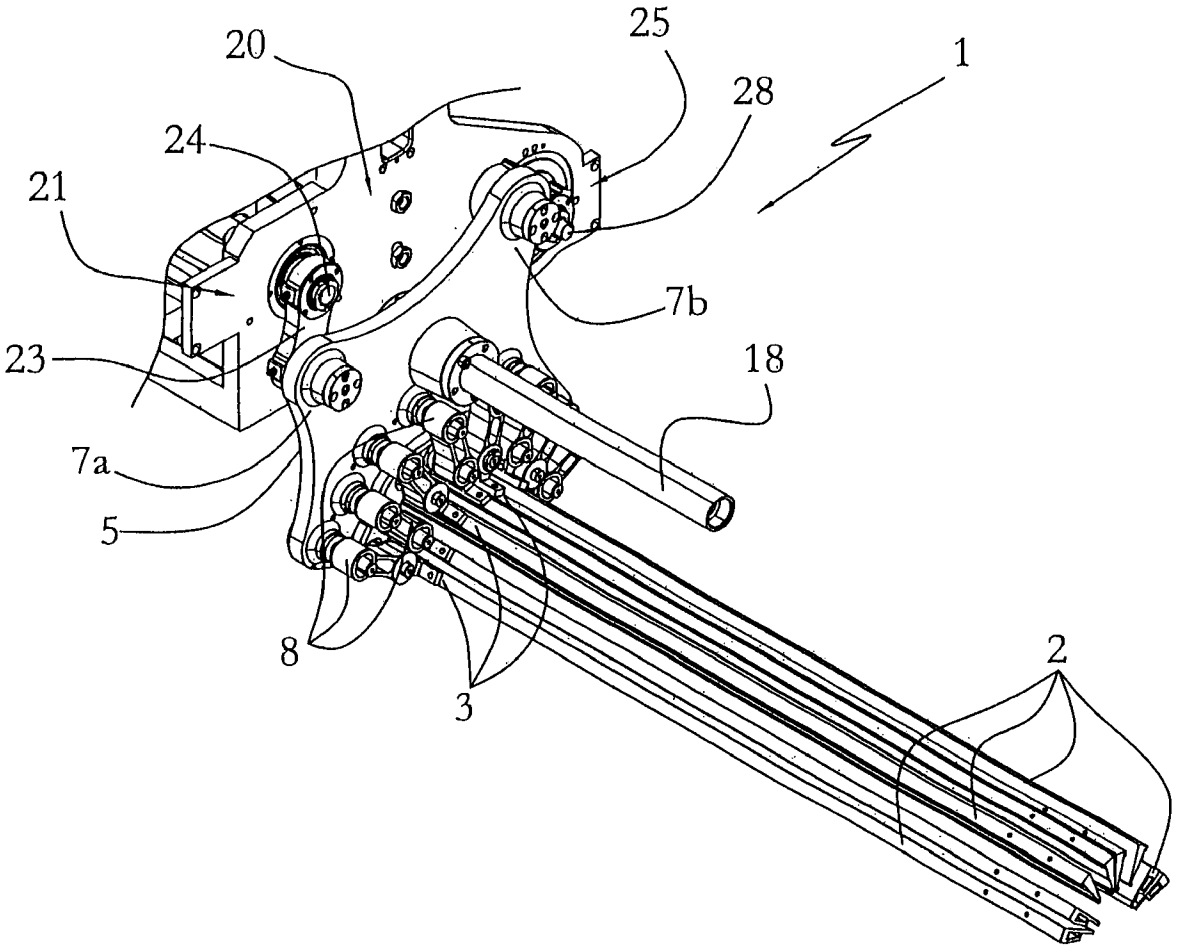
FIG. 7 shows a perspective view of the device of FIG. 3 associated to a first end portion of the thread-guide bars.
Figure 8:
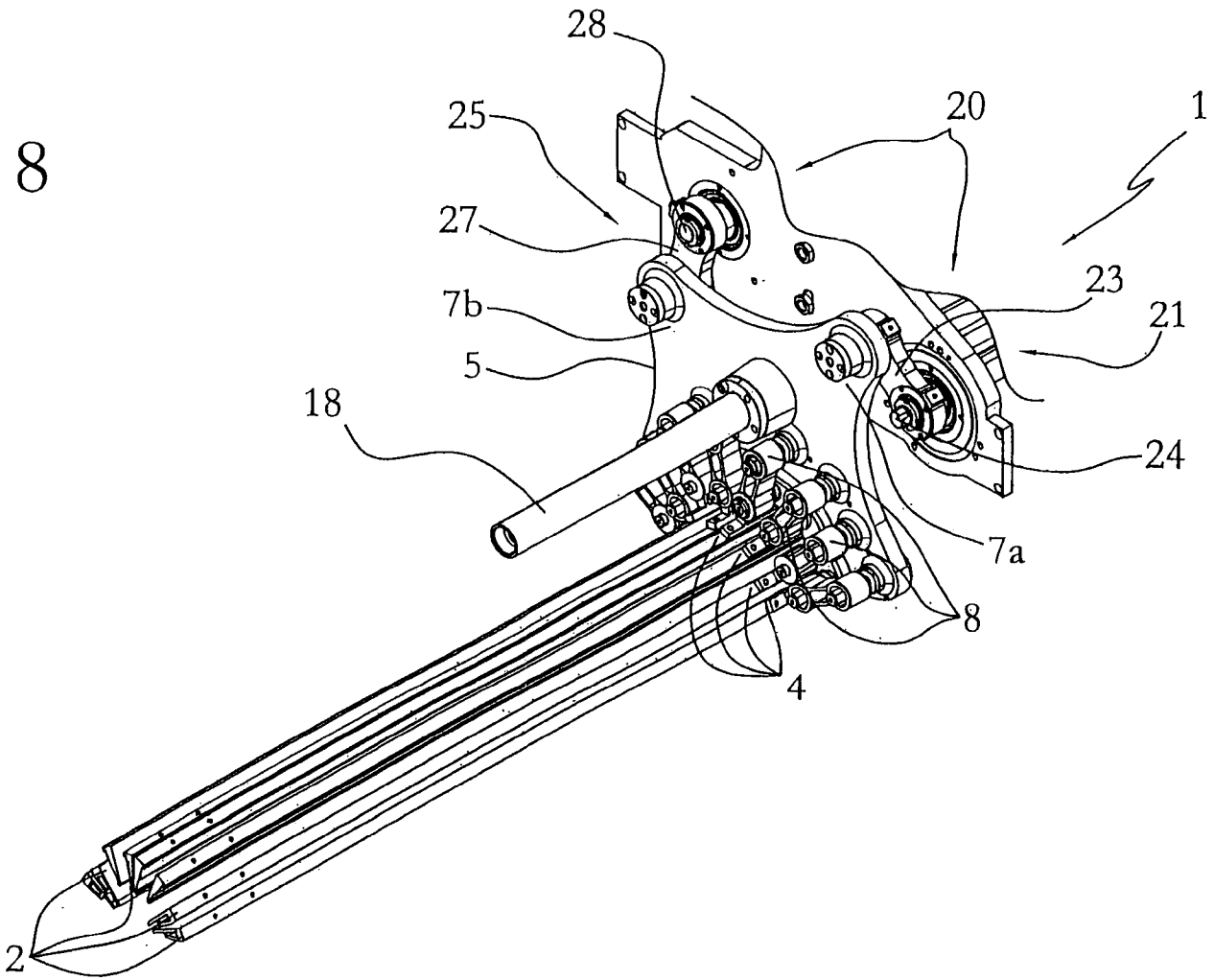
FIG. 8 shows a perspective view of the device of FIG. 3 associated to a second end portion of the thread-guide bars.

The transmission means 20 further comprise connection means 30 between the main transmission means 21 and the secondary transmission means 25, so as to transmit synchronously to the secondary transmission means 25 the movement supplied by the movement means 10 through the main transmission means 21 (FIGS. 3 and 6).

Figure 4:
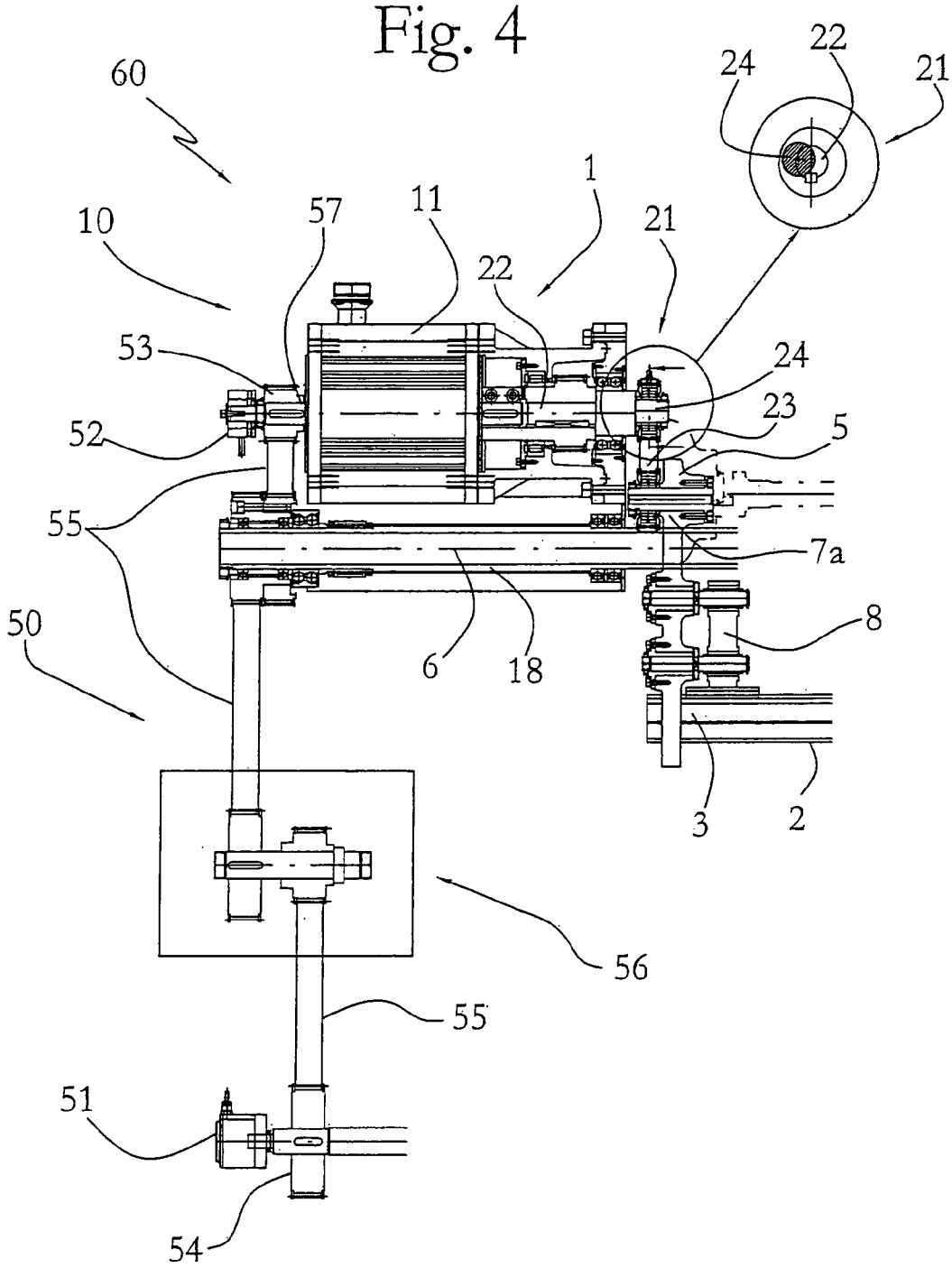
FIG. 4 shows a first schematic front view of a knitting machine according to the invention in a first embodiment thereof.

According to the invention, the main transmission means 21 comprise a main shaft 22 operatively connected to the movement means 10, and a main connecting rod 23 operatively associated to the main shaft 22 and to the support 5 on the first actuating point 7*a*. A further component of said means 21 is a main eccentric pin 24 associated to a portion of the main shaft 22, preferably to an end portion thereof, so that the main connecting rod 23 is fitted onto the main shaft 22 by means of said main eccentric pin 24 (FIG. 4).

In their turn, the secondary transmission means 25 comprise a secondary shaft 26 operatively associated to the connection means 30, and a secondary connecting rod 27 operatively associated to said secondary shaft 26 and to the support 5 on the second actuating point 7*b*. Preferably, the secondary transmission means 25 also comprise a secondary eccentric pin 28 associated to a portion, as a rule an end portion, of the secondary shaft 26. Here again, the connecting rod 27 is fitted onto the secondary shaft 26 by means of said secondary eccentric pin 28.

The secondary connecting rod 27 is designed to cooperate with the main connecting rod 23 for moving the support 5 with an oscillating movement.

The two shafts, the main one 22 and the secondary one 26, rotate synchronously, whereas their connecting rods 23, 27 operate with phase opposition due to the different location of the eccentric pin 24, 28 of the respective shafts 22, 26. Therefore, while one of them, the main connecting rod 23 for instance, pushes the support 5 and makes it rotate with respect to its middle axis 6 counterclockwise, the other one, the secondary one 27 for instance, pulls simultaneously the support 5 cooperating with the main connecting rod 23 so that said support rotates counterclockwise in a balanced manner.

Advantageously, the oscillating movement imparted by the main connecting rod 23 and by the secondary connecting rod 27 to the support is sinusoidal and dampened at its ends, i.e. during movement inversion. This allows to maximize the effectiveness of the movement since, both during acceleration and during braking, the two connecting rods 23, 27 cooperate to the movement by sharing in a fair manner the efforts and the absorptions of the forces of inertia generated at high oscillating speeds. Thus, this results in a harmonious movement without all negative components generated in known devices 1 moved with means operating only on one side, i.e. with only one connecting rod.

The connection means 30 comprise a main pulley 31 integrally associated to the main shaft 22, a secondary pulley 32 integrally associated to the secondary shaft 26, and a connection belt 33 associated to the two pulleys 31 and 32 for transmitting the movement of the main pulley 31 to the secondary shaft 26 exactly by means of the secondary pulley 32. Generally, in double needle-bed linear knitting machines 60, every support 5 is associated to approximately eight thread-guide bars 2. Preferably, the bars 2 are not associated to the support 5 directly but by means of secondary supports 8, to which only one bar 2 can be associated and which are integral with the support 5, as shown in FIGS. 3, 4, 5, 7 and 8. It should be pointed out that every secondary support 8 is integral with the support 5 as far as rotation is concerned, while it can move with translational motion with respect to the support 5 so as to enable the translation of the bars 2 as required for the movement of said bars 2 commonly known as "shog".

Figure 9:
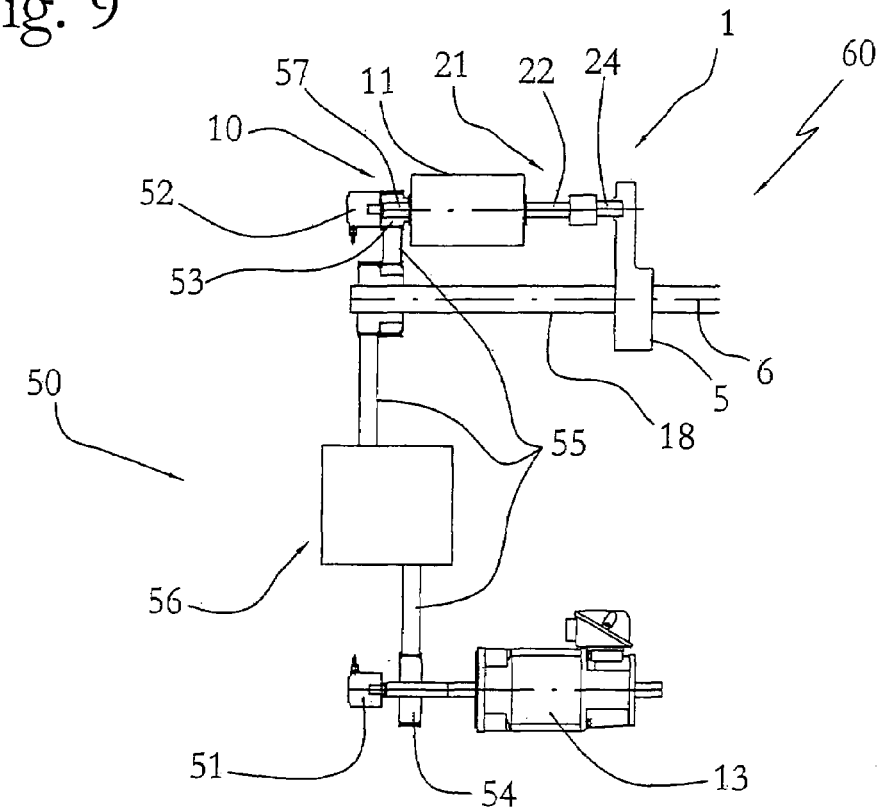
FIG. 9 shows a second schematic front view of the machine of FIG. 4.

In a first execution variant shown in detail in FIGS. 4, 6 and 9, which is also the preferred embodiment of the invention, the movement means 10 comprise at least one dedicated motor 11. This dedicated motor 11 is designed only to move the support 5 and is different from the central motor 13 moving the other elements of the machine 60 such as the needles.

In this case, therefore, the main shaft 22 is integrally connected to the dedicated motor 11, and the main connecting rod 23 is designed to convert the rotational motion of the main shaft 22 generated by the dedicated motor 11 into an oscillating motion for the support 5. Preferably, the dedicated motor 11 is a brushless motor, but other types suitable to this purpose can be used, such as stepper motors or direct current motors. As an alternative, two dedicated motors 11 synchronized with one another can be used, so as to move the main 21 and the secondary 25 transmission means, thus without the need for connection means 30 whose function is to move the secondary transmission means 25 starting from the movement of the main ones 21. Said solution, however, would be highly complex to be carried out and managed, especially due to the need for a perfect synchronization between the two dedicated motors 11, and would significantly increase costs.

Figure 10:
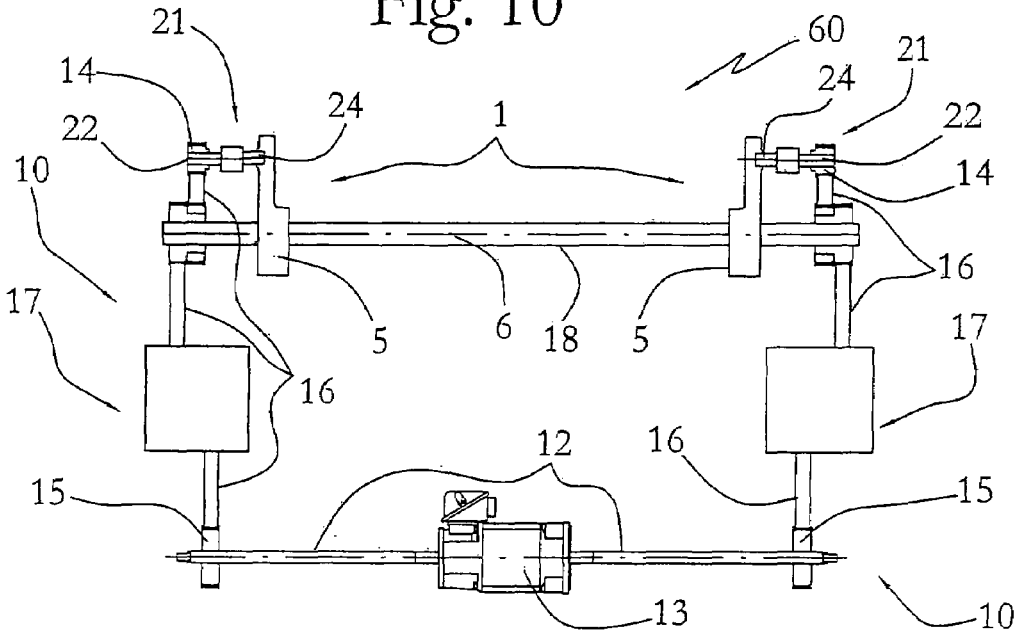
FIG. 10 shows a schematic side view of the machine according to the invention in a second embodiment thereof.

In a second execution variant of the invention shown in FIG. 10, the movement means 10 can be operatively associated to the central motor 13 of the machine 60. It should be pointed out that central motor 13 denotes the motor designed to move all the elements of the machine 60 and in particular the needles. In this case, therefore, the movement means 10 comprise a first movement pulley 14 operatively associated to the main shaft 22, a second movement pulley 15 that can be operatively associated to the central motor 13, and a movement belt 16 operatively connected to the first 14 and to the second 15 movement pulley for transmitting to the first movement pulley 14 the movement of the second movement pulley 15.

Advantageously, the movement means 10 can further comprise first means 17 for varying the rotational speed of the main shaft 22 with respect to the rotational speed of the central motor 13, associated to the movement belt 16. In further detail, said means 17 consist of reduction gears and are required when the main shaft 22 has to be moved at another angular speed than the one of the central motor 13 to which it is connected and from which it receives the movement, as typically occurs in double needle-bed linear knitting machines 60.

The inventive idea underlying the present invention extends also to a linear knitting machine 60 characterized in that it comprises at least one oscillating control device 1 for thread-guide bars 2 in accordance with the above description.

In particular, a linear knitting machine 60 in accordance with the invention generally comprises at least two oscillating control devices 1 for thread-guide bars 2. Preferably, one of these devices 1 is located on a first end portion 3 of the thread-guide bars 2, and another one is located on a second end portion 4, opposite the first one 3, so as to prevent torsions of said thread-guide bar 2 during oscillations.

Figure 5:
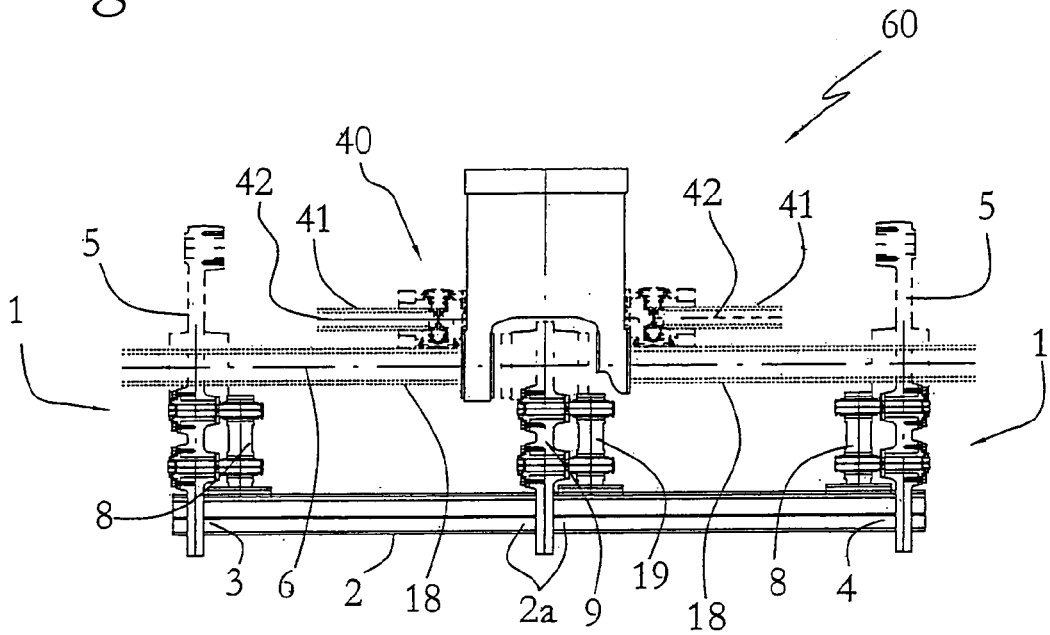
FIG. 5 shows a schematic front view of a detail of the machine according to the invention.

The machine 60 can further comprise at least one intermediate support 9 associated to the thread-guide bars 2 on an intermediate portion 2*a* thereof, located between the two end portions 3, 4, so as to support the latter (FIG. 5). Every intermediate support 9 can move with an oscillating movement around the central axis. Preferably, the intermediate supports 9 do not transmit to the thread-guide bars 2 the oscillating motion but only accompany the oscillations thereof by passively absorbing them. In some cases, however, the intermediate supports 9 can also actively transmit the oscillating movement to the bars 2 (which alternative is not shown). Advantageously, every support 5 and every intermediate support 9 are turnably associated to an oscillating shaft 18 whose main axis coincides with the central axis 6 around which said supports 5 rotate. Advantageously, the thread-guide bars 2 can be associated to every intermediate support, which houses all thread-guide bars 2, by means of a secondary intermediate support, as can be seen in FIG. 5.

The knitting machine 60 further comprises control means 40 designed to ensure the synchronism between the oscillating movement of the supports 5 of the two devices 1 associated to the end portions 3, 4 of the thread-guide bars 2, and to ensure the continuity of movement for the thread-guide bars 2 in case of failures. Said control means 40 comprise an auxiliary shaft 41 operatively associated to the secondary shafts 26 of the two devices 1, so as to stiffly connect said secondary shafts 26 (FIGS. 5 and 6).

The auxiliary shaft 41 has several functions beyond the one of ensuring the perfect synchronism between the two secondary shafts 26 as mentioned above. As a matter of fact, the auxiliary shaft 41 enables to ensure the continuity of movement in case some components break, such as a connection belt 33 between the main transmission means 21 and the secondary ones 25 of one of the two devices 1, since the auxiliary shaft 41 can move the secondary shaft 26 of the damaged device 1 by exploiting the movement of the secondary shaft 26 of the undamaged device 1. The same applies to a breakage or malfunctioning of the movement means 10, especially of the dedicated motor 11 in the first execution variant of the devices 1. However, the machine 60 is equipped with suitable sensors that are able to signal the emergency condition and to stop said machine 60 with suitable procedures.

Moreover, the auxiliary shaft 41 is adequately supported and perfectly able to rotate on its axis 42 at high speeds without causing unwanted vibrations in the transmission means.

A linear knitting machine 60 with oscillating control devices 1 for thread-guide bars 2 according to the first execution variant also comprises coordination means 50 between the central motor 13 and the dedicated motors 11 for adapting the movement of the dedicated motors 11 to the movement of the central motor 13 so as to synchronize the movement of the thread-guide bars 2 to the one of the needles. This function is highly important since the movements of the thread-guide bars 2 and of the needles have to be extremely stiff and coordinated so that all the needles are always correctly fed, thus preventing damages to the finished product or breakage of threads or needles.

Said coordination means 50 can be either electronic or mechanical.

In the first case, the coordination means 50 comprise at least one first detection element 51 associated to the central motor 13, designed to detect the angular position thereof, at least one second detection element 52 for each of the dedicated motors 11, designed to detect the angular position thereof, and an electronic adjustment element (not shown) designed to process the signals transmitted by the first 51 and by the second 52 detection elements so as to synchronize the dedicated motors 11 with the central motor 13 (FIGS. 4 and 9). For instance, the electronic adjustment element can be an electronic card connected to the electronic means running and managing the whole machine 60. Moreover, the first 51 and the second 52 detection elements can comprise position transducers of "encoder" or "resolver" type or of other type, which are able to indicate the exact angular position of the shaft moving with respect to a reference zero. In particular, the signal referring to the central motor 13 is commonly managed as main signal ("master signal") with which all the other movements of the machine 60 have to comply.

This allows to eliminate cams, back gears, leverages, rods, etc. which are required to connect stiffly and synchronously elements spaced apart even of some meters and which were difficult and expensive to be carried out. Despite being of electronic type, the coordination means 50 of this type are able to connect stiffly the central motor 13 to the dedicated ones 11, as if there were actually a stiff mechanical connection between them.

The rapidity of data transmission and execution makes the movement between the central motor 13 and the dedicated motors 11 harmoniously connected and rigorously controlled, since the coordination means 50 can follow in real time speed variations of the central motor 13 and adapt the mechanisms thereof under their control, in this case the dedicated motors 11.

As was already mentioned, the coordination between the central motor 13 and the dedicated motors 11 can also take place with mechanical coordination means 50 making use of conventional transmission. In this case, the coordination means 50 comprise at least one first coordination pulley 53, each of them being associated to each of the dedicated motors 11, a second coordination pulley 54 associated to the central motor 13, and a coordination belt 55 operatively connected to the first 53 and to the second 54 coordination pulley so as to move the first coordination pulley 53 according to the movement of the second one 54. The coordination means 50 can further comprise second means 56 for varying the rotational speed of the first coordination pulley 53 with respect to the second one 54, generally made up of reduction gears.

Moreover, in this case every dedicated motor 11 comprises two shafts, a first shaft made up of the main shaft 22, and a second shaft made up of a coordination shaft 57 operatively connected to the first coordination pulley 53.

This type of coordination means 50, which is perfectly functional, can introduce some delays due to the imperfect stiffness of the coordination belts 55, which delays are mitigated by reducing the operating speed of the machine 60.

The two types of coordination means 50 can also be used simultaneously so as to minimize the possible lack of synchronization between the central motor 13 and the dedicated motors 11 in case of breakages or failures of the various components.

In the solution of embodiment in which a linear knitting machine 60 comprises oscillating control devices 1 for thread-guide bars 2 according to the second execution variant, the central motor 13 has two shafts. As a matter of fact, said motor 13 has two shafts made up of the movement shafts 12 operatively connected to the second movement pulleys 15 of the two devices 1 associated to the first 3 and to the second 4 end portion of the thread-guide bars 2, respectively.

It should be pointed out that, preferably, all the belts and pulleys are toothed. However, the terms belt and pulley are to be construed as general terms representing any transmission element designed to perform the functions required by a knitting machine 60 in accordance with the inventive idea as described.

The invention thus conceived can undergo several changes and variants, all of which fall within the framework of the inventive idea.

In practice, any material or size can be used, depending on the various needs.

Moreover, all details can be replaced by technically equivalent elements.

The invention achieves important advantages.

Firstly, the presence of transmission means performing simultaneously a pushing and a pulling action onto the support makes the inversion of the direction of movement and the steps of acceleration and braking gradual and smooth. This enables to limit the size of the mechanical structure of the machine and the stresses (vibrations, shakes, . . . ) it undergoes during operation.

The structure of the machine is further simplified and made lighter in both execution variants as described also thanks to the particular shape of the movement means. As a matter of fact, in the first execution variant the use of dedicated motors allows to reduce the number of elements controlled by the central motor of the machine, which can therefore be reduced in size. In this embodiment, the structure of the machine is further reduced by using electronic coordination means positively affecting also the flexibility of the machine itself. In the second execution variant, the complicated leverages of known machines are replaced by a simple transmission system using preferably pulleys and belts. This makes the knitting machine simpler to be carried out and managed, especially as far as maintenance is concerned, and significantly reduces the costs thereof. Furthermore, the use of a push-pull system enables to balance the structure of the knitting machine and to reduce significantly its vibrations. For instance, the knitting machine according to the present invention allows to reduce vibrations also at a speed of 3,000 and more oscillations per minute.

Thanks to the lighter structure and the fewer vibrations, the devices according to the present invention can operate at high speeds reducing the criticalities of the knitting step with respect to the other steps of the manufacturing process of knitted items.

Finally, a further advantage consists in that the described devices, by controlling the oscillating movement and ensuring a high accuracy, ensure a high quality of the knitted items thus manufactured.

The invention claimed is:

1. An oscillating control device (1) for thread-guide bars (2) of warp linear knitting machines (60), comprising:

a support (5) that can rotate around a central axis (6) to which at least one thread-guide bar (2) can be associated, movement means (10) for said support (5), and transmission means (20) operatively connected to the movement means (10) for imparting an oscillating movement to said support (5);

characterized in that said transmission means (20) are operatively associated to said support (5) on at least two separate actuating points (7*a*, 7*b*) for moving said support (5) according to said oscillating movement in a balanced manner with respect to said central axis (6).

2. The device (1) according to claim 1, characterized in that said actuating points (7*a*, 7*b*) are opposed with respect to a vertical plane containing said central axis (6).

3. The device (1) according to claim 1, characterized in that a pushing action and a pulling action are applied simultaneously on said two actuating points (7*a*, 7*b*) by said movement means (10) through said transmission means (20).

4. The device (1) according to claim 1, characterized in that said transmission means (20) comprise main transmission means (21) operatively connected to said movement means (10), and secondary transmission means (25) operatively associated to said main transmission means (21) and moved by said main transmission means (21), said main transmission means (21) acting upon said support (5) at a first (7*a*) of said actuating points and said secondary transmission means (25) acting upon said support (5) on a second (7*a*) of said actuating points.

5. The device (1) according to claim 4, characterized in that said main and secondary transmission means (21, 25) exert simultaneously onto said support (5), by means of the corresponding actuating points (7*a*, 7*b*), said pushing action said the pulling action, respectively, or vice versa.

6. The device (1) according to claim 4, characterized in that said transmission means (20) further comprise connection means (30) between said main transmission means (21) and said secondary transmission means (25), designed to transmit synchronously to said secondary transmission means (25) the movement supplied by said movement means (10) through said main transmission means (21).

7. The device (1) according to claim 4, characterized in that said main transmission means (21) comprise a main shaft (22) operatively connected to said movement means (10), and a main connecting rod (23) operatively associated to said main shaft (22) and to said support (5) on said first actuating point (7*a*).

8. The device (1) according to claim 7, characterized in that said main transmission means (21) further comprise a main eccentric pin (24) associated to a portion of said main shaft (22), said main connecting rod (23) being associated to said main shaft (22) by means of said main eccentric pin (24).

9. The device (1) according to claim 7, characterized in that said secondary transmission means (25) comprise a secondary shaft (26) operatively associated to said connection means (30), and a secondary connecting rod (27) operatively associated to said secondary shaft (26) and to said support (5) on said second actuating point (7*b*) and designed to cooperate with said main connecting rod (23) for moving said support (5) according to said oscillating movement.

10. The device (1) according to claim 9, characterized in that said oscillating movement imparted by said main connecting rod (23) and by said secondary connecting rod (27) to said support (5) is sinusoidal.

11. The device (1) according to claim 9, characterized in that said secondary transmission means (25) further comprise a secondary eccentric pin (28) associated to a portion of said secondary shaft (26), said secondary connecting rod (27) being associated to said secondary shaft (26) by means of said secondary eccentric pin (28).

12. The device (1) according to claim 9, characterized in that said connection means (30) comprise a main pulley (31) integrally associated to said main shaft (22), a secondary pulley (32) integrally associated to said secondary shaft (26), and a connection belt (33) associated to the said main pulley (31) and to said secondary pulley (32) for transmitting the movement of said main pulley (31) to the secondary shaft (26) by means of said secondary pulley (32).

13. The device (1) according to claim 1, characterized in that it further comprises at least one secondary support (8) to which one of said thread-guide bars (2) can be associated, said at least one secondary support (8) being associated to said support (5).

14. The device (1) according to claim 7, characterized in that said movement means (10) comprise at least one dedicated motor (11).

15. The device (1) according to claim 14, characterized in that said main shaft (22) is connected integrally to said dedicated motor (10), and in that said main connecting rod (23) is designed to convert a rotational motion of said main shaft (22) generated by said dedicated motor (11) into said oscillating movement for said support (5).

16. The device (1) according to claim 1, characterized in that said dedicated motor (11) is a brushless motor.

17. The device (1) according to claim 1, characterized in that said movement means (10) can be operatively associated to a central motor (13) of said machine (60), designed to move the needles of said machine (60).

18. The device (1) according to claim 17, characterized in that said movement means (10) comprise a first movement pulley (14) operatively associated to said main shaft (22), a second movement pulley (15) that can be operatively associated to said central motor (13), and a movement belt (16) operatively connected to said first (14) and to said second (15) movement pulley for transmitting to said first movement pulley (14) the movement of said second movement pulley (15).

19. The device (1) according to claim 17, characterized in that said movement means (10) further comprise first means (17) for varying the rotational speed of said main shaft (22) with respect to the rotational speed of said central motor (13) associated to said movement belt (16).

20. A warp linear knitting machine (60) characterized in that it comprises at least one oscillating control device (1) for thread-guide bars (2) according to claim 1.

21. The machine (60) according to claim 20, characterized in that it comprises at least two of said devices (1), one of said devices (1) being positioned on a first end portion (3) of said at least one thread-guide bar (2) and one being positioned on a second end portion (4) opposite said first end portion (3), so as to prevent torsions of said at least one thread-guide bar (2).

22. The machine (60) according to claim 21, characterized in that it further comprises at least one intermediate support (9) associated to said at least one thread-guide bar (2) on an intermediate portion (2*a*) thereof located between said first (3) and said second (4) end portion, for supporting said at least one thread-guide bar (2), said intermediate support (9) being movable according to said oscillating movement around said second middle axis (6).

23. The machine (60) according to claim 20, characterized in that it further comprises control means (40) designed to ensure the synchronism between said oscillating movement of said supports (5) of said devices (1) and to ensure the continuity of movement for said at least one thread-guide bar (2) in case of failures.

24. The machine (60) according to claim 23, characterized in that said control means (40) comprise an auxiliary shaft (41) operatively associated to said secondary shafts (26) of said two devices (1) associated to said at least one thread-guide bar (2), designed to stiffly connect said secondary shafts (26).

25. The machine (60) according to claim 20, characterized in that it further comprises coordination means (50) between said central motor (13) and said dedicated motors (11), designed to adapt the movement of said dedicated motors (11) to the movement of said central motor (13) for synchronizing the movement of said at least one thread-guide bar (2) to the movement of the needles.

26. The machine (60) according to claim 25, characterized in that said coordination means (50) comprise a first detection element (51) associated to said central motor (13) and designed to detect the angular position of said central motor (13), at least one second detection element (52), said at least one second detection element (52) being associated to each of said dedicated motors (11) for detecting the angular position of said dedicated motors (11), and an electronic adjustment element designed to process signals transmitted by said first (51) and by said second (52) detection element for synchronizing said dedicated motors (11) with said central motor (13).

27. The machine (60) according to claim 26, characterized in that said first (51) and said second (52) detection element comprise transducers of angular position.

28. The machine (60) according to claim 25, characterized in that said coordination means (50) further comprise at least one first coordination pulley (53), associated to each of said dedicated motors (11), a second coordination pulley (54) associated to said central motor (13), and a coordination belt (55) operatively connected to said first (53) and to said second (54) coordination pulley so as to move said first coordination pulley (53) according to the movement of said second coordination pulley (54).

29. The machine (60) according to claim 28, characterized in that said coordination means (50) further comprise second means (56) for varying the rotational speed of said first coordination pulley (53) with respect to said second coordination pulley (54).

30. The machine (60) according to claim 28, characterized in that said dedicated motor (11) has two shafts, the first one made up of said main shaft (22) and the second one made up of a coordination shaft (57) operatively connected to said first coordination pulley (53).

31. The machine (60) according to claim 20, characterized in that said central motor (13) has two shafts made up of movement shafts (12) operatively connected to said second movement pulleys (15) for the two devices (1), associated to said first (3) and to said second (4) end portion of said at least one thread-guide bar (2), respectively.

* * * * *